US009399504B2

(12) United States Patent
Salz

(10) Patent No.: US 9,399,504 B2
(45) Date of Patent: Jul. 26, 2016

(54) AERODYNAMIC WINGSAIL

(71) Applicant: David B. Salz, Davie, FL (US)

(72) Inventor: David B. Salz, Davie, FL (US)

( * ) Notice: Subject to any disclaimer, the term of this patent is extended or adjusted under 35 U.S.C. 154(b) by 0 days.

(21) Appl. No.: 14/672,109

(22) Filed: Mar. 28, 2015

(65) Prior Publication Data

US 2015/0274273 A1 Oct. 1, 2015

Related U.S. Application Data

(60) Provisional application No. 61/971,791, filed on Mar. 28, 2014.

(51) Int. Cl.
*B63H 9/04* (2006.01)
*B63H 9/06* (2006.01)

(52) U.S. Cl.
CPC ..... *B63H 9/0607* (2013.01)

(58) Field of Classification Search
CPC ... B63H 9/0607; B63H 9/0614; B63H 9/0635
USPC ..... 114/102.22, 102.24, 102.33, 102.26
See application file for complete search history.

(56) References Cited

U.S. PATENT DOCUMENTS

| | | | | | |
|---|---|---|---|---|---|
| 2,106,209 | A | | 1/1938 | Edge | |
| 2,711,708 | A | | 6/1955 | Thornburg | |
| 4,064,821 | A | | 12/1977 | Roberts et al. | |
| 4,386,574 | A | * | 6/1983 | Riolland | B63H 9/0607 114/102.26 |
| 4,418,632 | A | * | 12/1983 | Yoshimi | B63H 9/0607 114/102.32 |
| 4,624,203 | A | | 11/1986 | Ferguson | |
| 4,677,928 | A | | 7/1987 | Hoyt | |
| 4,699,073 | A | | 10/1987 | Farneti | |
| 4,934,295 | A | | 6/1990 | Atkinson et al. | |
| 5,271,349 | A | * | 12/1993 | Magrini | B63H 9/0607 114/102.33 |
| 5,288,039 | A | * | 2/1994 | DeLaurier | B64C 3/52 244/219 |
| 5,619,946 | A | | 4/1997 | Wallasch | |
| 5,826,530 | A | | 10/1998 | Tuurna et al. | |
| 6,141,809 | A | | 11/2000 | Lyngholm | |
| 6,431,100 | B2 | * | 8/2002 | Abshier | B63H 9/04 114/102.1 |
| 6,662,738 | B2 | | 12/2003 | Estabrooks | |
| 6,892,660 | B2 | | 5/2005 | Ketterman | |
| 7,574,972 | B1 | * | 8/2009 | Fairchild | B63H 9/0607 114/102.22 |
| 7,798,084 | B2 | * | 9/2010 | Stroj | B63H 9/0642 114/102.1 |

FOREIGN PATENT DOCUMENTS

| | | |
|---|---|---|
| GB | 1117529 | 6/1968 |
| WO | 03039948 | 5/2003 |
| WO | 2012020441 | 2/2012 |

* cited by examiner

*Primary Examiner* — Stephen Avila
(74) *Attorney, Agent, or Firm* — Malin Haley DiMaggio & Bowen, P.A.

(57) ABSTRACT

An aerodynamic wingsail and mast assembly, which does not utilize a boom or gaff, and which is simply designed to include a singular sailcloth and resilient bow rod which are removably attached to a free standing mast. The bow rod includes a pair of open-ended brackets to engage the mast, and is positioned in a curved sleeve on the trailing edge of the sailcloth. The sailcloth includes a forward sleeve for receiving the mast. Flanges on the mast engage the brackets, and the sailcloth is simply slid off the mast by releasing the brackets and tension of the bow rod. Alternative embodiments are described for 3 dimensional wingsails.

18 Claims, 13 Drawing Sheets

AERODYNAMIC WINGSAIL

CROSS REFERENCE TO RELATED APPLICATIONS

This application claims priority from the Provisional Application, Ser. No. 61/971,791, filed on Mar. 28, 2014.

STATEMENT REGARDING FEDERALLY SPONSORED RESEARCH OR DEVELOPMENT

N/A

BACKGROUND OF THE INVENTION

1. Field of the Invention

The present invention relates generally to sailing vessels, and more particularly to unique designs for aerodynamic wingsails having lightweight sail clothes, support members, mast features, hardware assemblies, as well as operation and control components.

2. Description of the Prior Art

Since their invention over thousands of years ago, sailboats have evolved in a multitude of fascinating ways. Many of the design advances made during that time were practical in nature, such as improving safety and simplifying operation, while others were made specifically to increase boat speed. For example, the recently developed rigid wingsails used on the America's Cup catamarans have only increased speed, while compromising simplicity and safety.

U.S. Pat. No. 6,892,660 is entitled Furling Sail and Means For Turning Mast, and discloses a furling sail and particular hardware/ball bearing assembly for turning the mast. The sail is described as to be fully battened by several thin, spaced apart battens which are positioned about steep angles to the sail. The battens are made of fiberglass rods which are held in place by cord and threaded through a batten. The lower ends of the battens are free to rotate inside pockets. This patent teaches the use of a rotating mast and diagonal battens to improve the functionality of a sail. In contrast, the instant inventive wingsail is supported by rotating brackets on a mast that does not rotate. The '660 patent incorporates an A-frame to support the upper mast bearing, functioning as a fixed base supporting the mast. The inventive wingsail herein utilizes two movable struts to form a tilting triangular base that supports the mast.

U.S. Pat. No. 5,619,946 is entitled Sail Furling Device With Bearings To Permit Simultaneous Cable And Extrusion Rotation, and illustrates a furling device and a particular upper and lower bearing assembly which compensate for static and horizontal loads, and rotates both the luff extrusion and the sail cable wire.

U.S. Pat. No. 4,699,073 is entitled Spaced Double Surface Sail Constructions, and relates to a spaced double surface sail construction wherein a sail envelope has an inner open area between two spaced sail surfaces. The sail surfaces have spaced battens, and battens support strips support, space, and guide the center portion of the battens. A batten socket support strip supports and spaces the batten sockets along the mast, and permitting pivotal movement. This wingsail has battens that pivot on the mast and are moved from side to side within the wingsail surface and camber is only reversible, not adjustable.

U.S. Pat. No. 4,064,821 is entitled Variable Camber Wing Sail, which describes a wing sail having a variable camber and having a two (2) sided spaced apart sail structure, including a plurality of resiliently deformable struts for each side.

The beam produces a cam action to bend the struts producing an airfoil configuration. The design utilizes dual sliding tracks on rotating masts supporting twin sails that form thick wingsail profiles. Unlike the inventive wingsail, the masts are the leading edges of these wingsails, and include a variable camber control device consisting of a rigid boom and two pulleys connected to a bracket on the mast that also supports flexible battens that extend from the mast to the trailing edge of the surface. In contrast, the battens in the inventive wingsail surround the mast, forming the leading edge of the surface forward of the mast.

However, none of the above-referenced patents or the prior art address the designs, components and/or operation of the instant aerodynamic wingsail, which constitutes a substantial improvement over the art. Furthering previous wingsail concepts, the invention described below combines the superior aerodynamic efficiency of wingsails with the safety and simplicity of the best modern technology, thereby creating a useful and beneficial advance in sailboat evolution.

It is therefore an objective of the present invention to provide an improved lightweight wingsail and vessel with custom designed components providing for superior aerodynamic performance.

It is yet another objective of the present invention to provide an improved lightweight wingsail and vessel which eliminates problems with prior designs and provides enhanced benefits for operation and control.

Finally, it is an objective of the present invention to provide to provide an improved lightweight wingsail and vessel which is cost effective and operationally efficient while incorporating the above mentioned objects and features.

SUMMARY OF THE INVENTION

Furthering previous wingsail concepts, the invention presented herein combines the superior aerodynamic efficiency of wingsails with safety and simplicity rivaling conventional sails, thereby creating a useful advance in sailboat evolution. The present inventions relate to aerodynamic wingsails comprising lightweight sail cloths that have integral internal tubular slots which contain flat batten strips which are resilient and made of carbon fiber or other spring like material such as plastic/metal composites, fiberglass or the like. To form dual surfaces for the "wing" sail, the surface is folded in half about its centerline creating the wing profile around the mast. Related novel hardware and components control the deployment and operation of the wingsail and vessel, as the engineering designs also include top and bottom bracket assemblies, camber control components, hinged arms, bearings, floatation blocks, and certain free standing mast applications (having no stays). A unique fundamental wingsail is also disclosed having minimal components and simplicity of operation.

BRIEF DESCRIPTION OF THE DRAWINGS

The invention may be better understood by reference to the drawings in which.

DETAILED DESCRIPTION OF PREFERRED EMBODIMENTS

Fundamental Wingsail

Figure 1A:
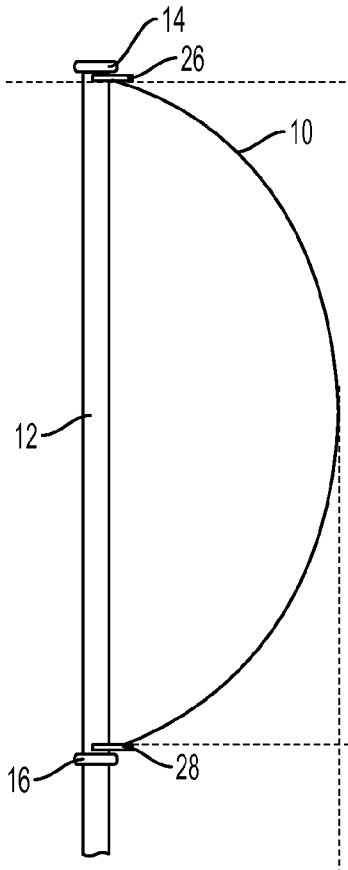
FIG. 1A is a side plan view of an inventive wingsail having a fundamental design, along with a bow rod, U-shaped brackets and corresponding mast flanges.
Figure 1B:
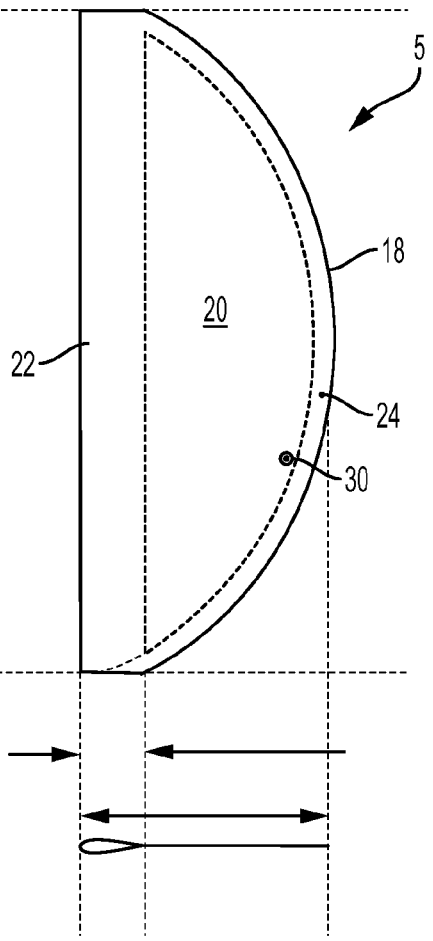
FIG. 1B is a side plan view of the inventive sailcloth and surface attached to the apparatus shown in FIG. 1A.
Figure 1C:
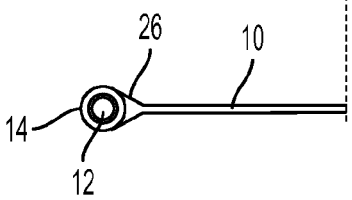
FIG. 1C is a partial top plan view of FIG. 1A.

The fundamental design of an inventive wingsail 5 of the instant invention is shown in FIGS. 1A and 1B. This novel design utilizes a tensioned bow rod 10, a structural component of simplicity yet effectiveness, to replace previous methods of supporting and tensioning sails. The entire device consists of a curved or tubular mast 12 with two flanges 14 and 16, a cloth sail 18, bow 10 and a singular control rope. The semi-circular sailcloth surface 20 has internal sleeves 22 and 24 for the mast 12 and bow rod 10. The bow is a tensile rod with U-shaped brackets 26 and 28 on each end. The preferred rod materials are fiberglass and carbon fiber, but bamboo and hardwoods are viable alternatives. The wingsail surface 20 is tensioned between the bow rod 10 and mast 12 when the U-shaped brackets 26 and 28 are captured on the mast between the two flanges, one above and the other below the wingsail 5. The flange beneath the wingsail may be fixed to the mast or it can be a movable clamp that provides a vertical tension adjustment and a simple way to release all of the tension in the bow rod for transport.

The rotation of the wingsail 5 is controlled by a rope (not shown) attached to grommet 30, and can be tied around the rod 10 as well, that supports the trailing edge. The wingsail rotates freely in response to the wind unless there is tension on the rotation rope. Left free to rotate, it continually turns in the direction of the wind while creating minimal thrust from drag. Thrust is created as aerodynamic lift when the operator uses the rotation rope to pull the wingsail toward the wind. Releasing the rotation rope stops the thrust immediately. This simple on-off function is extremely intuitive and risk free, providing greater safety than previous sailing systems.

Folding the wingsail is also a simple operation, because the bow rod 10 straightens alongside mast 12 as soon as the tension is released, either by sliding a clamp downward or by bending the bow rod 10 to unhook the lower bracket 28 from the mast. This basic version of the quintessential wingsail can also be raised and lowered about the mast by sliding the bow rod up or down.

In addition to the novel safety advantages, this fundamental wingsail 5 is also substantially more efficient than conventional sails. The generally semi-circular shape creates the efficiency advantage of elliptical area distribution, which increases the lift to drag ratio by providing uniform pressure distribution without the need for specific contouring of the surface. This theoretical principle was discovered in the early 20th century by Ludwig Prandtl, the father of aerodynamics. Furthermore, unlike conventional sails, the instant wingsails can always be aligned to the wind for maximum thrust, even when sailing downwind. With conventional sailing rigs, the mast support wires prevent the sail from rotating toward the front of the boat and therefore limit downwind sailing to the inefficient regime of simply being pushed by the wind. To overcome that limitation, many sailboats raise additional sails when sailing downwind, while the instant invention provides comparable thrust from a single easily controlled wingsail. Furthermore, the increased lift to drag ratio of this design also minimizes the side pressure that causes sailboats to lean over.

The novel self-tensioning structure of wingsail 5 has the extraordinary physical characteristic of uniformly distributed tension. This rare attribute, known as distributed compliance, is a structural ideal that maximizes strength and stability without rigidity or high tension. This advantage does not exist with previous sail and wingsail designs, which are classified as lumped compliance devices because they concentrate tension on one or more points. Benefits of distributed compliance include self-stabilization, extreme reliability and safety.

3 Dimensional Morphing Wingsail

Figure 10:
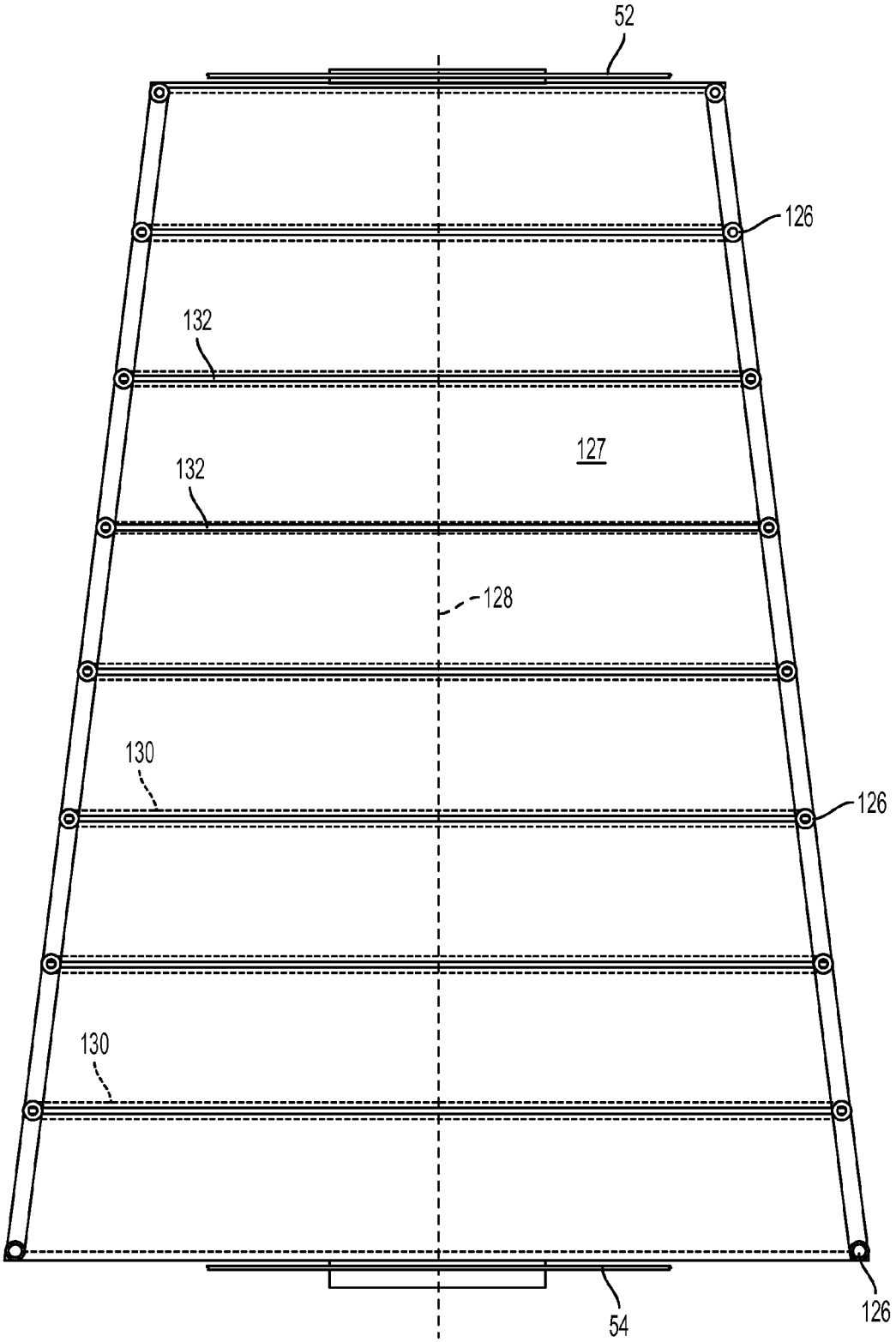
FIG. 10 is a side plan view of a generally rectangular wingsail of the instant invention.

With reference to FIGS. 2A, 2B, 3 and 4, similar to the fundamental wingsail discussed above, the surface 32 of the inventive 3D morphing wingsail 34 is made of lightweight sailcloth (nylon in the preferred embodiment). However, unlike the basic version, it does not fit directly onto mast 36. Instead, it is supported by integral horizontal tubular slots 38 containing flat batten strips made of carbon fiber or another flat spring material, such as fiberglass, stainless steel or the super elastic nickel titanium alloy (The batten strips and slots are shown are generally shown in FIG. 10 below in conjunction with an alternative rectangular wingsail). To form the rounded leading edge 40 and dual surfaces 42, 44 of the wing profile, this surface 32 is folded in half along the vertical axis 46. The batten strips tension the surface horizontally while springing it outward to support the flexible airfoil profile of the wingsail surface as shown in cross-section in FIGS. 2A and 2B. To create the horizontal tension, the ends of the batten strips are captured by sewn-in end pockets or end caps, which are the common methods of tensioning battens in conventional sails.

It is also understood that the curvature and shape of the wingsail surfaces can be designed to be generally oval, circular, elliptical or otherwise depending on the design parameters of choice.

The rounded leading edge of the wingsail surface is tensioned vertically by connections to the curved, generally oval portions of top and bottom brackets 48 and 50, respectively (top and bottom brackets are further illustrated in detail and discussed below in conjunction with FIGS. 7A, 7B, 9A and 9B). Those connections are made by drawstring flaps 52 and 54 at the top and bottom ends of the wingsail surface. The drawstring flaps are secured into grooves in the circumference of the oval brackets. The grooves and edges have relatively smooth and slip enhancing surfaces that allow the flaps to easily slide around the oval as the camber is adjusted and/or changed.

Mast 36 includes a top pulley 56, and the two brackets 48, 50 are free to rotate 360 degrees about the mast. The oval top bracket 48 and wingsail surface 32 are raised and lowered with a halyard assembly and a rope 58 that runs over the mast top pulley and down to a pulley and cleat (or a winch) on bottom bracket 50. A clamp mounted on the mast just above the bottom bracket prevents it from sliding upward. The rod that supports the trailing edge of the wingsail has a central hinge 60 that protrudes through an opening in the surface when the wingsail is lowered. As the wingsail is raised, two rod sections 62 and 64 are forced into the arc shape by the vertical tension and the constraint formed by the arc of the wingsail surface 32, as particularly illustrated in FIGS. 5 and 6.

Figure 2A:
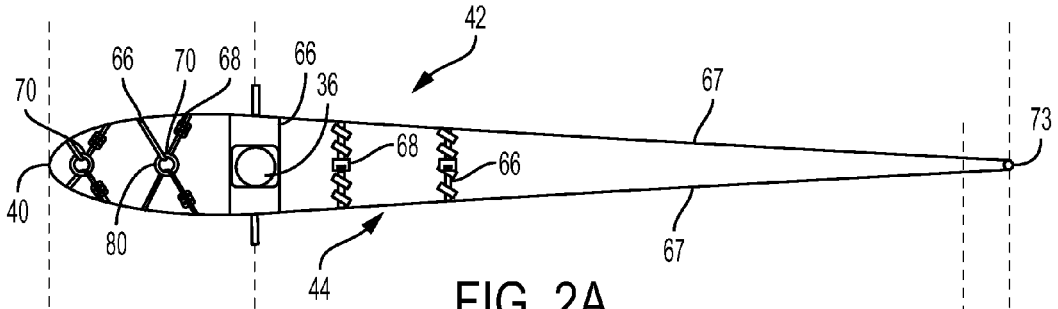
FIGS. 2A and 2B are cross-sectional top plan views of an alternative embodiment for the wingsail of the instant invention, illustrating internal components in both straight and cambered modes.
Figure 2B:
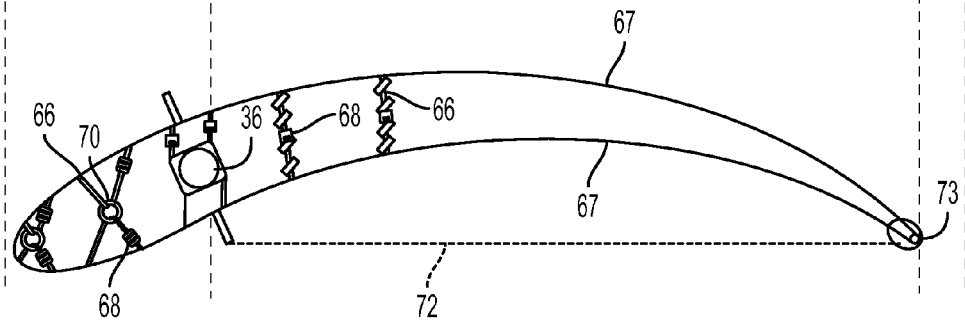
Figure 3:
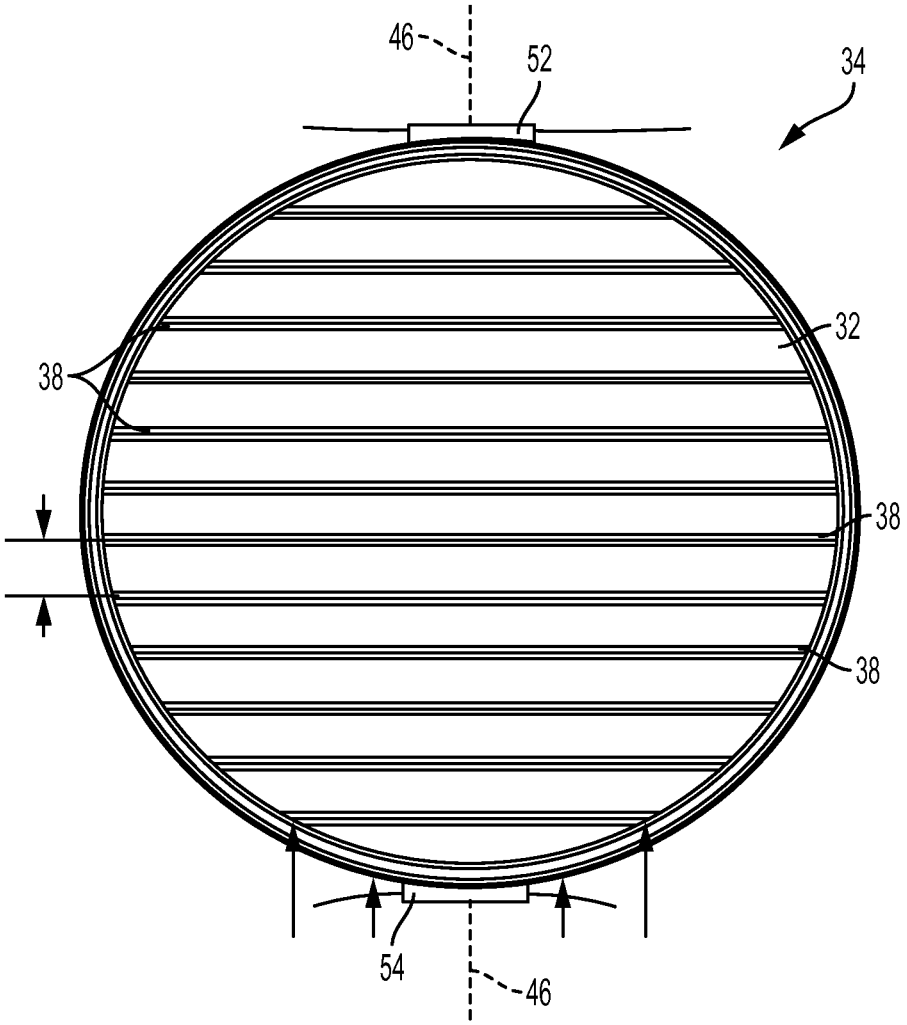
FIG. 3 is a side plan view of an alternative embodiment of a wingsail surface of the instant invention.
Figure 4:
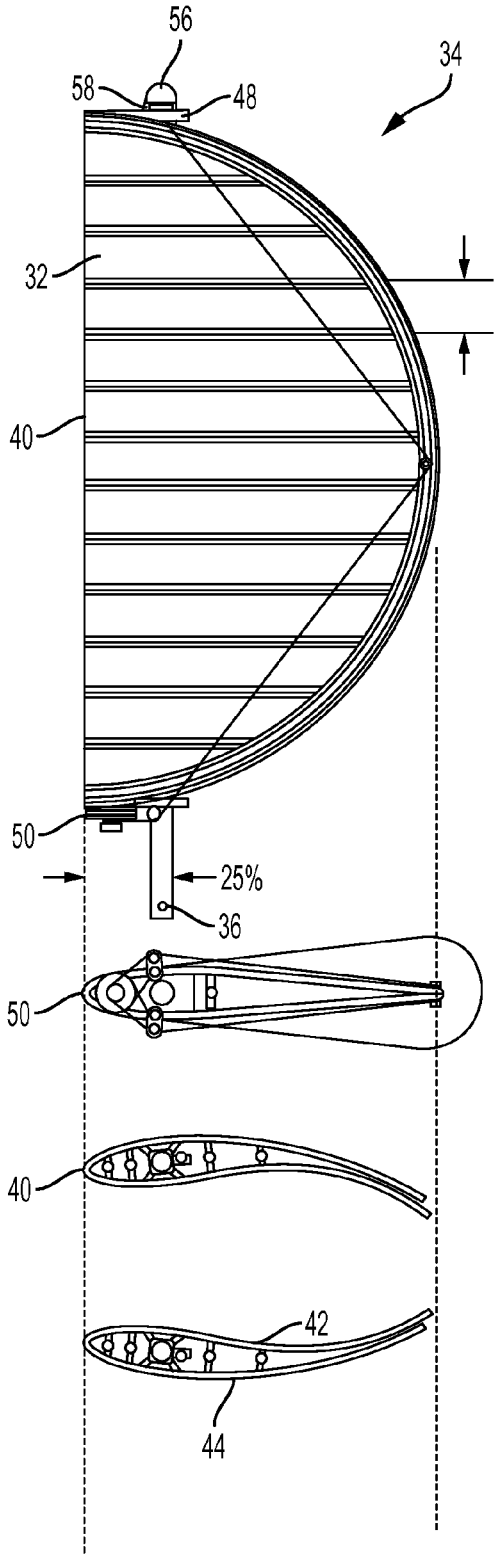
FIG. 4 is a side plan view of a portion of the wingsail shown in FIG. 3, along with diagrams depicting the device in both straight and cambered modes.

With reference to FIGS. 2A, 2B a series of flexible cords or straps 66 attached to the battens along the inner surface of the wingsail 34 perform the function of holding the two sides of the surface inward under tension, stabilizing the airfoil shaped cross-section of the wing. The cords or straps 66 also encircle the mast, connecting the wingsail surface to the mast 36 at the height of each batten 67. Textile straps or cords can be looped around the flat batten strips that run horizontally through the slots in the surface of the wingsail. These flexible connections are lightweight, durable and substantially different from prior wingsail components. Straps 66 are interconnected with quick release buckles 68 that facilitate detailed wing profile adjustments in addition to efficient assembly and disassembly. Straps 66 within the trailing portion of the wingsail may be covered with spiral cut or whole plastic tubing to maintain the airfoil thickness. The straps can be adjusted individually or they can be linked together by vertical straps, thus enabling airfoil profile optimization while sailing.

An additional structural innovation provides the dimensional flexibility that creates the continuously adjustable, optimally curved and fully reversible airfoil profiles. Internal straps 66 that tension the wingsail surface inward must also allow the surface to move across the leading edge from one side of the wingsail to the other as the camber is changed. That horizontal movement has been made possible by a system of rings 70 and straps 66. Straps 66 move freely within rings 70 providing a corresponding enhancement, flexibility and movement of wingsail and its profile. Ring material can be a lightweight plastic, but preferably stainless steel, as the added weight improves the overall mass balance of the wingsail. The rings 70 interact with the straps to maintain the leading edge radius as cambering shifts the surface around the mast. The rings also serve as counterweights to assist in keeping the mass of the wing balanced about the mast. As shown in FIG. 2B, camber actuator rope 72 and pulley control the trailing edge 73 of the batten rod.

Figure 5:
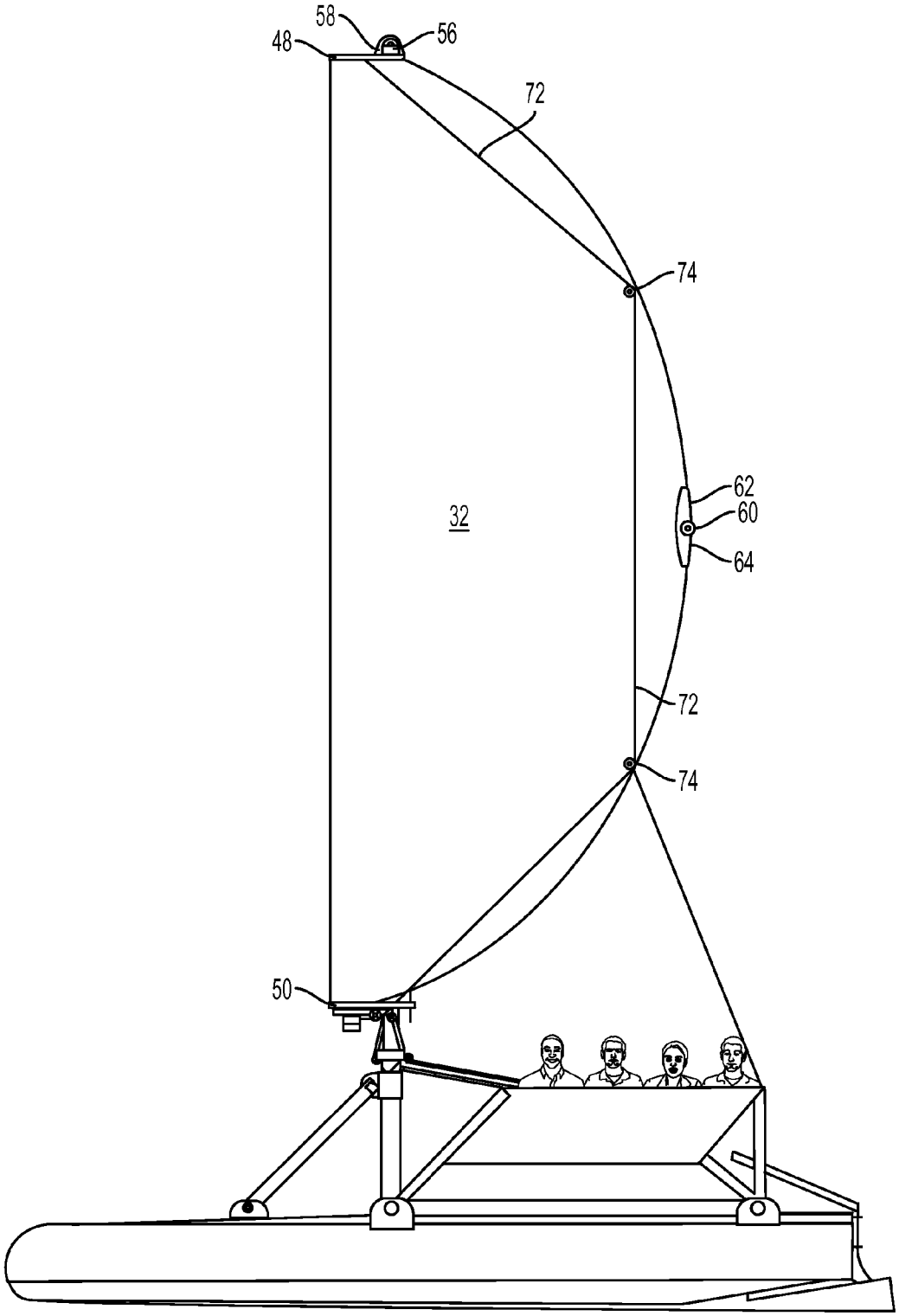
FIG. 5 is a side plan view of a marine vessel incorporating the instant invention, with an alternative wingsail extended.
Figure 6:
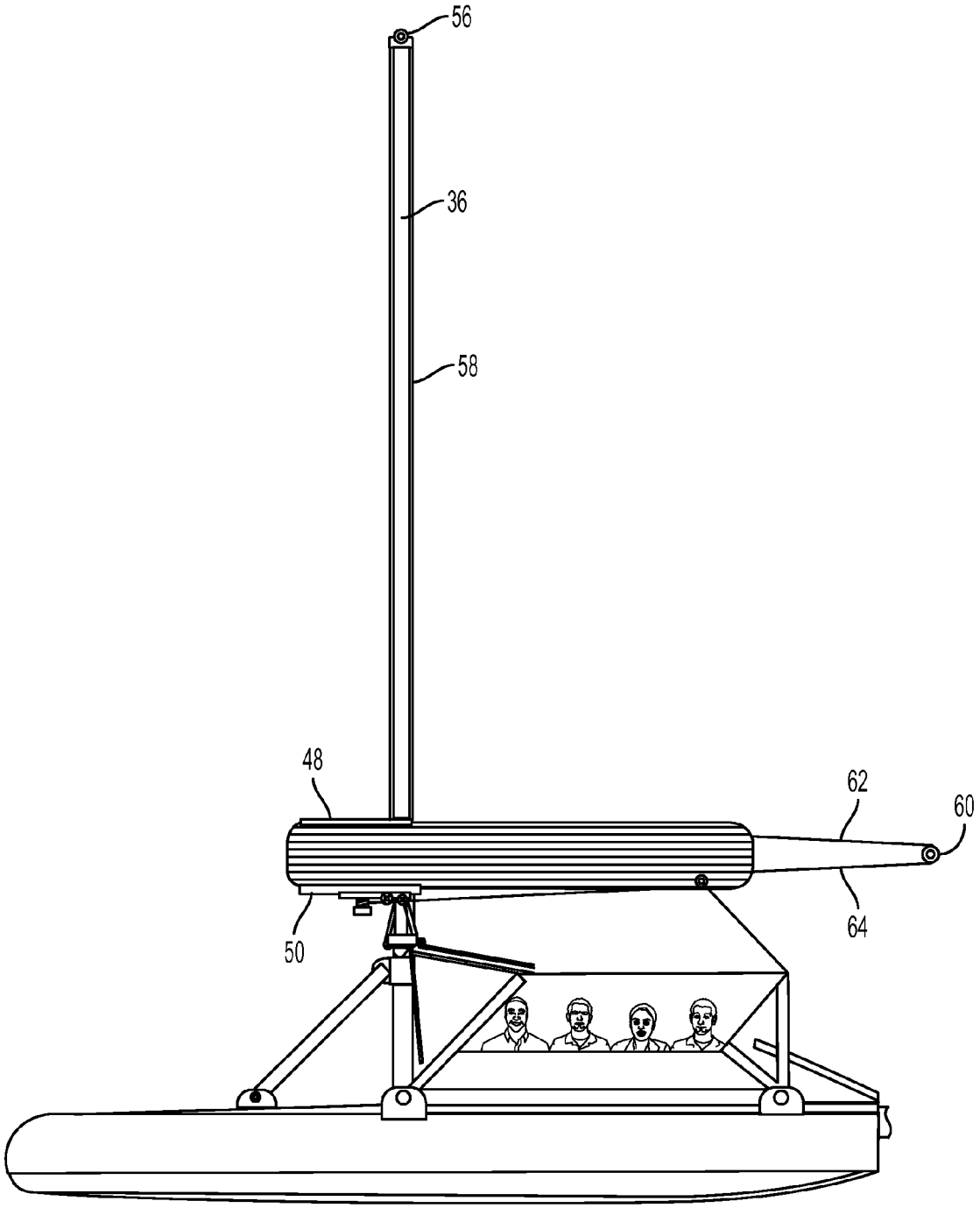
FIG. 6 is a side plan view of a vessel incorporating the instant invention with the wingsail in a retracted position prior to deployment.

With reference to FIG. 5, camber control rope 72 runs from top bracket 48 though pulleys 74 at the trailing edge of the wingsail, to a locking mechanism at lower bracket 50. Wingsail surface 32 is also tensioned vertically through the drawstrings positioned through the drawstring flaps and within the bracket grooves as previously described. The arc shaped trailing edge batten rods tension the surface both horizontally and vertically.

Like many sailing rigs, the alignment of the wingsail to the wind is controlled by a rope connected to the trailing edge. Unlike conventional single-surface sails, which are located completely behind the mast, the dual surfaces of this wingsail surround the mast and place it approximately 25% of the way from the leading edge to the trailing edge. This results from the geometric design of the top and bottom curved brackets and placement of the mast aperture therein. Locating the mast at that position within the wingsail cancels most of the turning force produced by wind, creating a 'semi-balanced' condition that greatly reduces the controlling force required to keep the wingsail optimally aligned with the wind. The turning force of the wind is so low that this wingsail may be controlled by simply holding the rotation rope directly, providing a more tactile feeling of the wind pressure than when pulleys are used. Nonetheless, rotation control pulleys or other devices may be necessary or preferred depending upon the specific application and individual preferences.

As with conventional sails, the natural tendency of the upper wingsail surface to twist away from the wind is aerodynamically beneficial because it compensates for the wind speed gradient, which varies wind speed in relation to height above the water. The gradually decreasing wind angle toward the top of the wingsail effectively evens out the pressure distribution, thereby improving efficiency.

Since the inventive wingsail rotates easily, it is desirable for its mass to be balanced about the mast to minimize rotation caused by boat movement. To avoid such unwanted movement, this wingsail design provides nearly neutral mass balance. Specifically, the strap rings, oval bracket sections and camber mechanism are located forward of the mast, while most of the wingsail surface and the bow are located behind the mast. Consequently, any remaining mass imbalance will be minimal and easily correctable with small balancing weights.

An additional inventive safety feature can be realized by mounting a form-fitted block of plastic foam to the underside of the top bracket within the surface. That flotation improves safety by resisting submersion when the boat is tipped on its side. An inventive alternate flotation material is a form-fitted inflatable plastic float that would replace the foam block, potentially saving weight, cost and storage space.

Camber Control System

A camber (curvature) control system, consisting of a plurality of pulleys and two ropes, provides detailed control of the airfoil camber. This continuous curvature adjustment enables the operator maximize thrust over a wide range of wind speeds.

Figure 7A:
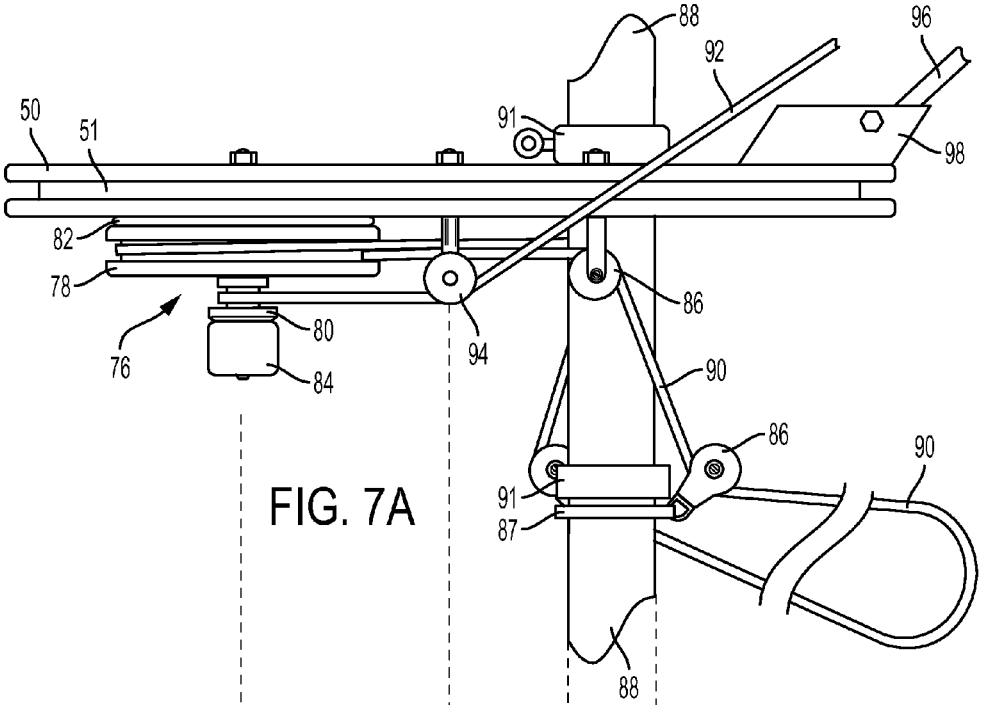
FIG. 7A is a side plan view of the lower camber control and bow rod assembly, including mast section, oval bracket, stepped pulley, bow rod attachment, control actuator and camber control ropes, and guides, of the instant invention.
Figure 7B:
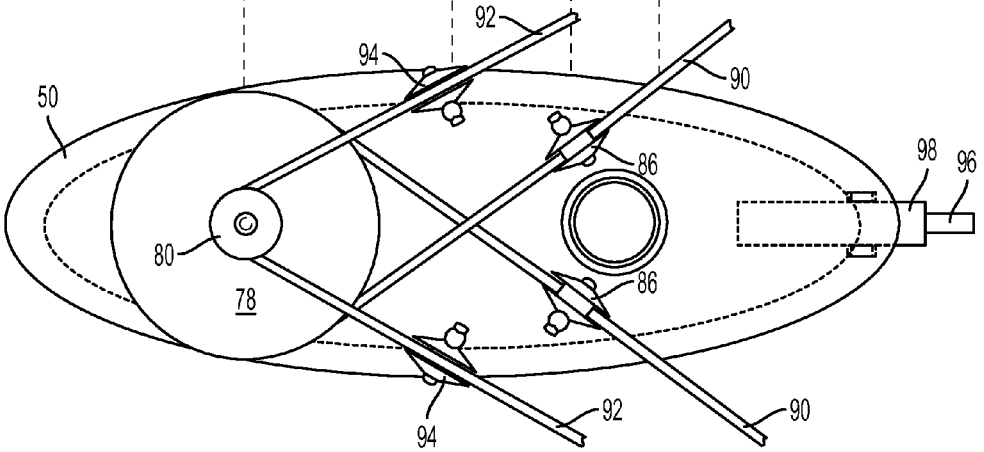
FIG. 7B is a partial bottom view of that shown in FIG. 7A.

Referring to FIGS. 7A and 7B, the camber control system is illustrated. The central component of the camber control system is lower bracket 50 and stepped pulley 76, having a larger upper pulley 78 and small lower pulley 80. An adjustable friction brake is incorporated, having friction pad 82 and camber tension knob 84. The diameter differential (8 to 1 range is preferable) between the two joined pulleys provides the necessary mechanical advantage to easily change the wing camber by pulling on camber control rope 90 that turns larger pulley 78 via four small guide pulleys 86, two on each side of mast 88. Guide pulleys 86 are secured to rotating rings 87 about mast 88. The stepped pulley diameter ratio may vary according to the size of the wingsail and other design considerations.

Mast clamps 91 can be utilized to selectively position the oval brackets about the mast.

Pulling the camber control rope 90 in either direction shifts the camber in that same direction because it turns both sections of stepped pulley 76. Smaller pulley 80 controls camber actuator rope 92, which runs through the guide pulleys 94 located on both sides of oval bracket 50 and connects to the trailing edge of the wingsail surface and upper bracket 48. The friction brake prevents the camber from changing until the control rope is pulled. Consequently, the camber control rope 90 never needs to be secured to maintain a setting.

The two lowest camber control pulleys 86, located next to the mast clamp, are mounted on a ring or rope that rotates freely around the mast. That rotational freedom avoids unwanted wing rotation that would otherwise be caused by pulling on the camber control rope. The ring achieves that benefit by allowing the active pulley to move directly in line between the mast and the operator as the rope is pulled.

The bracket, pulleys and control assemblies illustrated in FIGS. 7A, 7B are used in conjunction with wingsail incorporating the bow features described above. In these wingsails, bow rod 96 is secured to bracket 50 utilizing attachment member 98.

Mast Features

The wingsails described above are most effective when used on masts that are free-standing, meaning that they are not supported by stays, which are wires that connect the top of a conventional mast to the front and sides of the boat. The use of stays would prevent the highly advantageous 360 degree motion of the wingsail. Instead of stays, the mast may be inserted into a rigid structural socket for support. That socket could be part of the boat hull or it could be an additional structure.

With reference to FIGS. 12A, 12B, 13A and 13B, the inventive mast socket 100 disclosed herein is supported by two forward-facing diagonal struts 102, 104 that form a rigid triangular structure. A sliding clamp 106 on the mast socket connects to the struts, which are preferably angled approximately 90 degrees apart and 45 degrees downward toward their pivoting connections to the forward hull(s) when mast socket 100 is vertical.

There are many advantages to this arrangement, including fewer parts than stayed sail rigs and the ability to easily tilt the mast down toward the rear of the boat for assembly and transport. In the preferred embodiment, the mast and struts are carbon fiber tubes; however other materials, such as fiberglass, aluminum or even bamboo may also be utilized. Since sliding clamp 106 vertically on mast socket 100 changes the fore and aft angle of the mast and wingsail, aerodynamic efficiency can be improved by optimizing that angle for variations in sailing conditions. Improved control of the fore and aft angle may be facilitated with the inventive solution of a crank and gear mechanism that raises and lowers the clamp on the mast socket.

There are substantial safety and performance benefits afforded by the 360 degree rotational freedom of this wingsail design. Since there are no stays to prevent it from turning in any direction, releasing the rotation rope always releases the power of the wind. This is vastly safer than rigs with stays, which can easily break when user error or a failed part allows the sail to swing freely. This design also eliminates the danger of overpowering, because excessive wind force is automatically released by the flexibility of the structure. Excessive wind can cause conventional sail rigs to break or the boat to capsize unless the operator quickly releases the sail and/or turns the boat into the wind.

Mast Canting

Figure 13A:
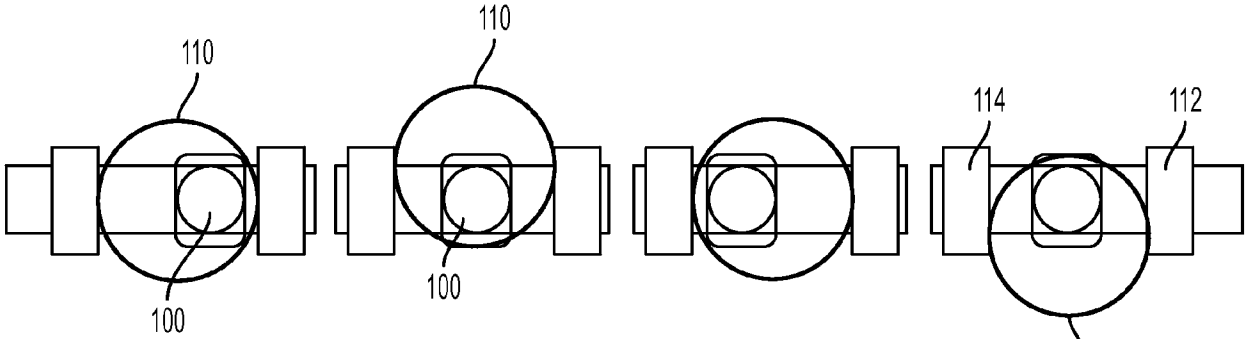
FIG. 13A is a top plan view illustrating the shifting of the mast socket by the canting apparatus shown in FIGS. 12A and 12B.
Figure 13B:
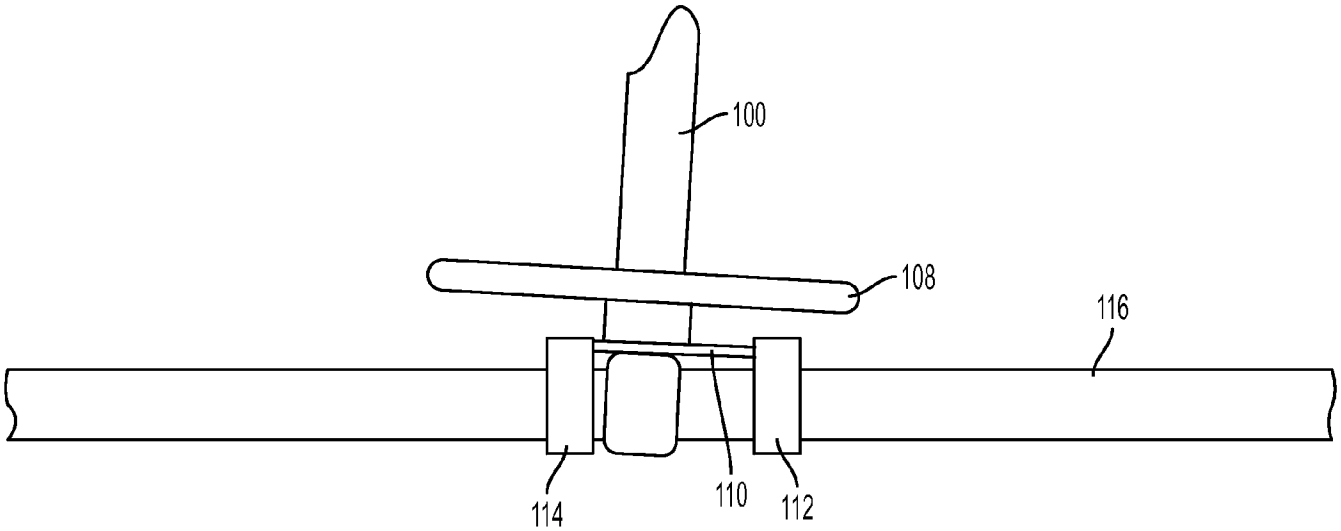
FIG. 13B is an enlarged view of the canting apparatus of the instant invention.

Additional aerodynamic advantages may be provided by the side to side tilting adjustment known as mast canting. Canting reduces the leaning and downward force of the wind by tilting the top of the wingsail toward the wind. The instant system depicted in FIGS. 12A-13B facilitates side to side tilt adjustments of the wingsail. This system utilizes control wheel 108 that rotates around the base of mast socket 100. Beneath the wheel is an offset mounted circular disc 110 that interacts with clamps 112 and 114 on crossbeam 116, moving the mast base from side to side as the wheel is turned. FIG. 13A is a top plan view illustrating the disc shifting of the mast socket from side-to-side sequences as it rotates against the clamps on the catamaran or sailing vessel crossbeam. FIG. 13B illustrates the disc and wheel that tilt the mast socket 100 as it rotates.

Trapezoidal Version Supported by Gaff and Boom

Figures 8A, 8B:
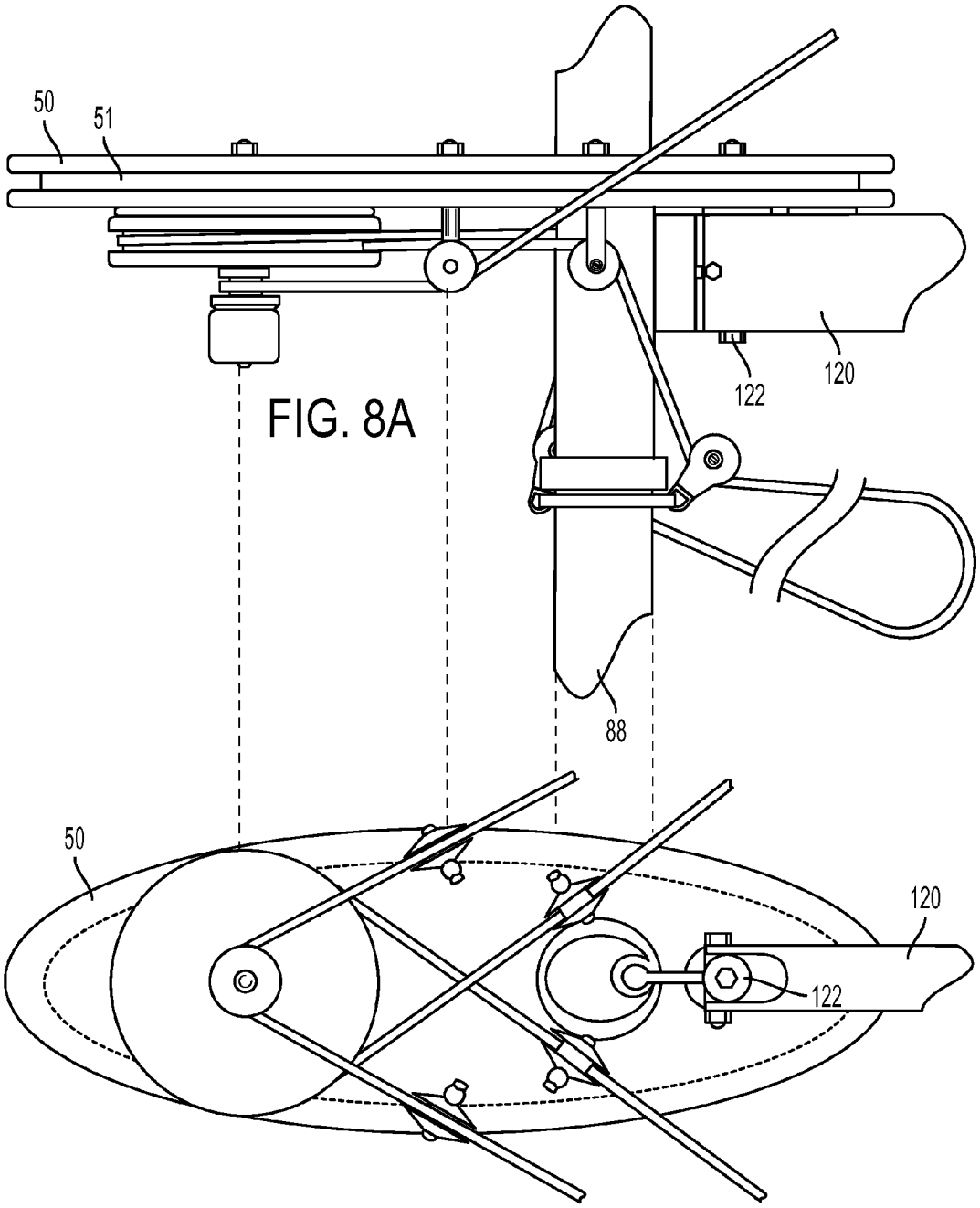
FIG. 8A is a side plan view of the lower camber control and boom assembly being utilized in conjunction with an alternative embodiment wingsail, including mast section, oval bracket, stepped pulley, boom, control actuator and camber control ropes, and guides, of the instant invention.
FIG. 8B is a partial bottom view of that shown in FIG. 8A.
Figure 9A:
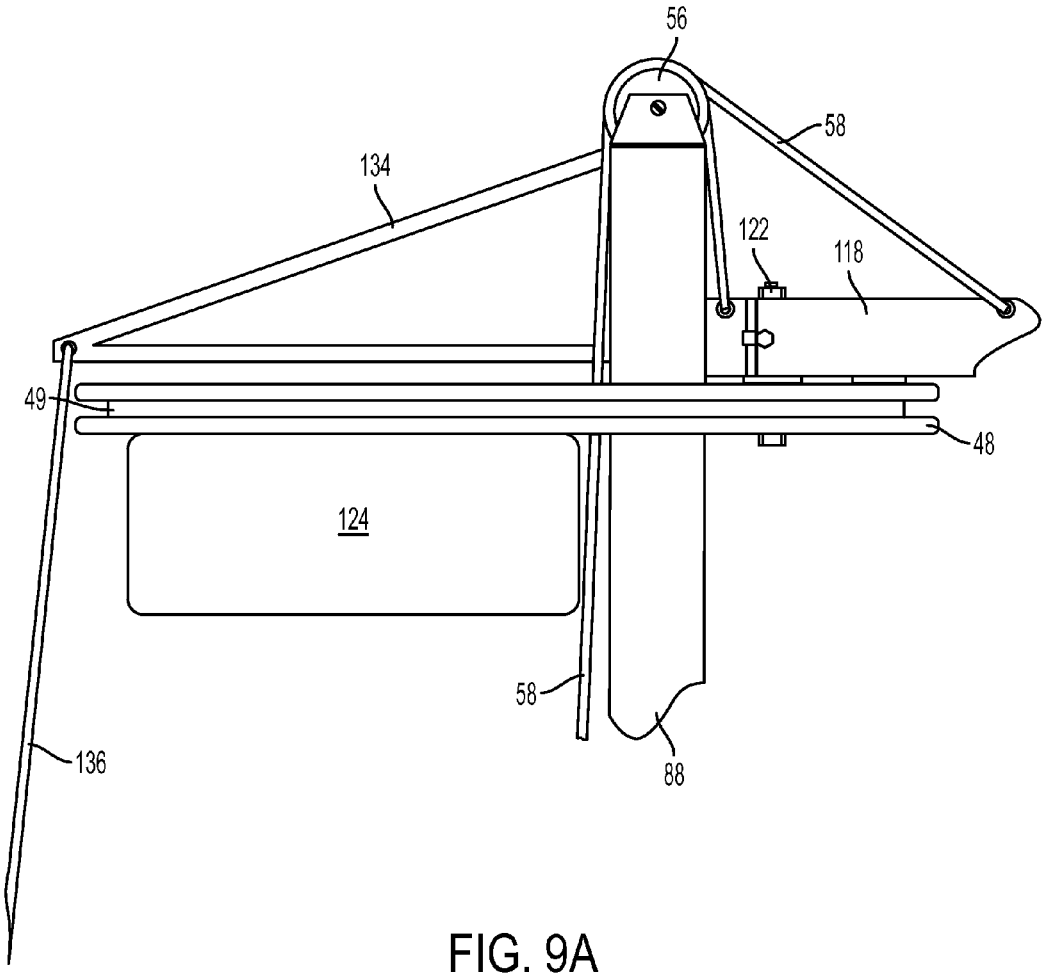
FIG. 9A is a side plan view of the top bracket and gaff assembly, including mast section, pulley, triangular fore bracket, oval bracket, control ropes and floatation block, of an alternative embodiment of the instant invention.
Figure 9B:
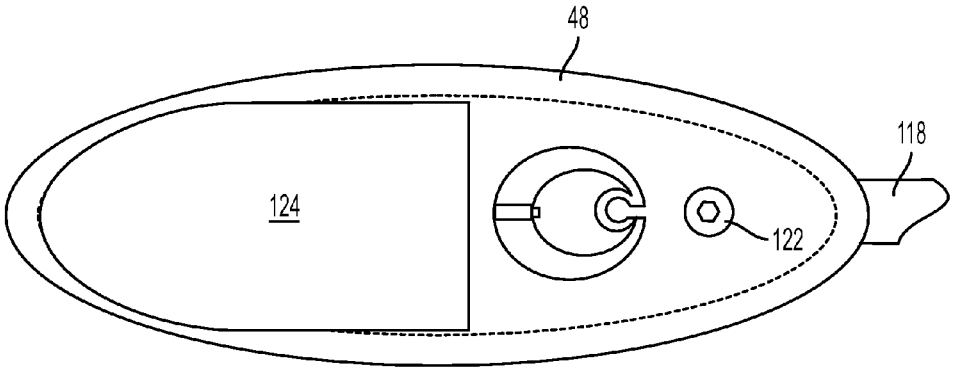
FIG. 9B is a partial bottom view of that shown in FIG. 9A.

A trapezoidal version of the 3D wingsail can replace conventional sails on boats that have stayed masts. With reference to FIGS. 8A, 8B, 9A and 9B, in this embodiment, the inventive bow is replaced by a conventional gaff 118 and boom 120 with added pivoting oval brackets 48 and 50 that support and tension the wingsail surface. The Bracket 50 and camber control apparatus, pulley system and components illustrated in FIGS. 8A and 8B, are seen to be substantially identical to that shown and described in conjunction with FIGS. 7A and 7B; the difference is the substitution of boom attachment assembly for the bow rod attachment assembly. The oval brackets 48 and 50 are fastened to the gaff 118 and boom 120 with hinges 122 that allow them to pivot horizontally in relation to the gaff and boom, providing the flexibility needed for aerodynamic cambering.

The upper and lower oval brackets 48 and 50 incorporate grooves 49 and 51 to accommodate the drawstrings described earlier.

A flotation block 124 attached to the upper bracket 48 assists with righting a turned vessel.

Figure 11:
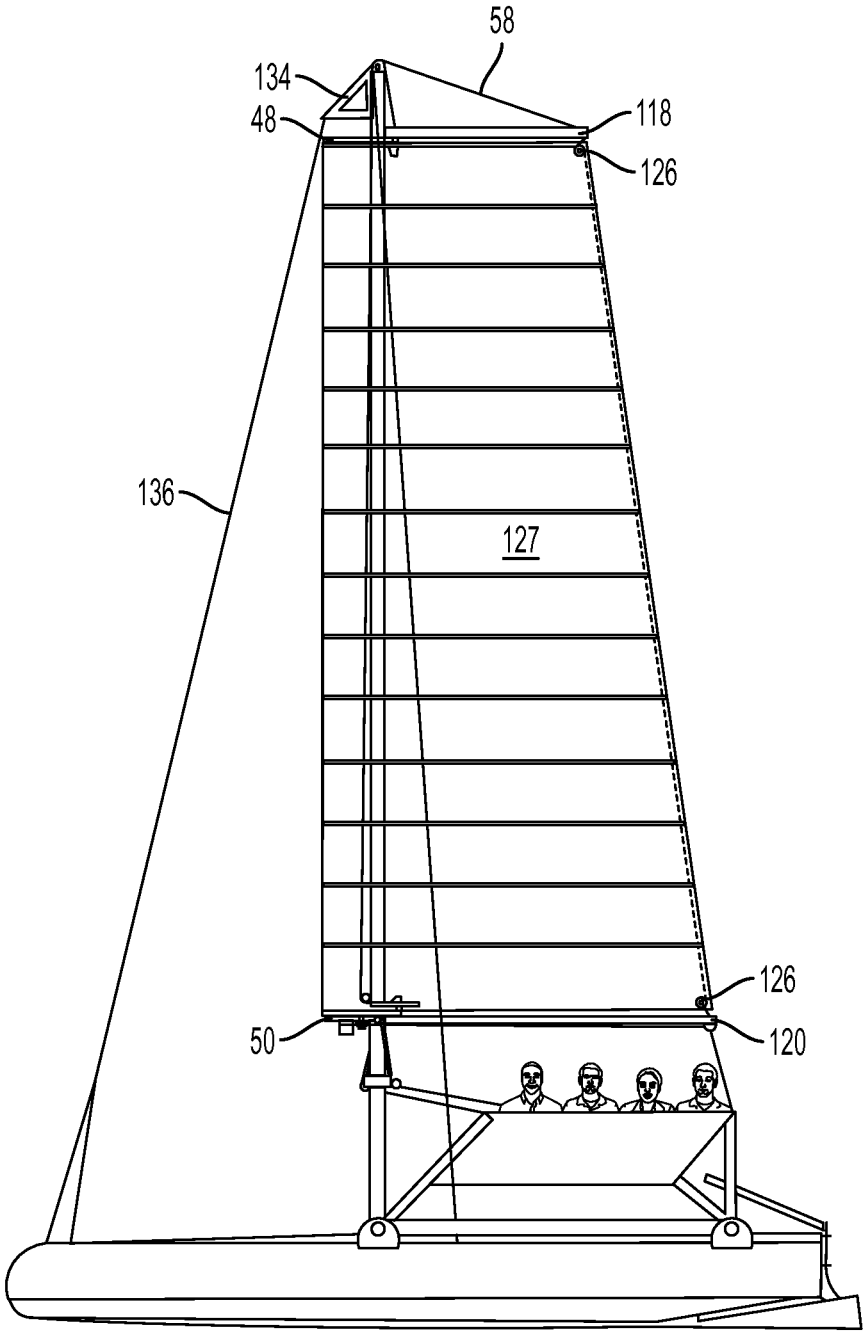
FIG. 11 is side plan view of a Marine vessel incorporating the instant invention, with the wingsail extended, along with the mast, brackets, battens, gaff and boom of the instant invention.
Figure 12A:
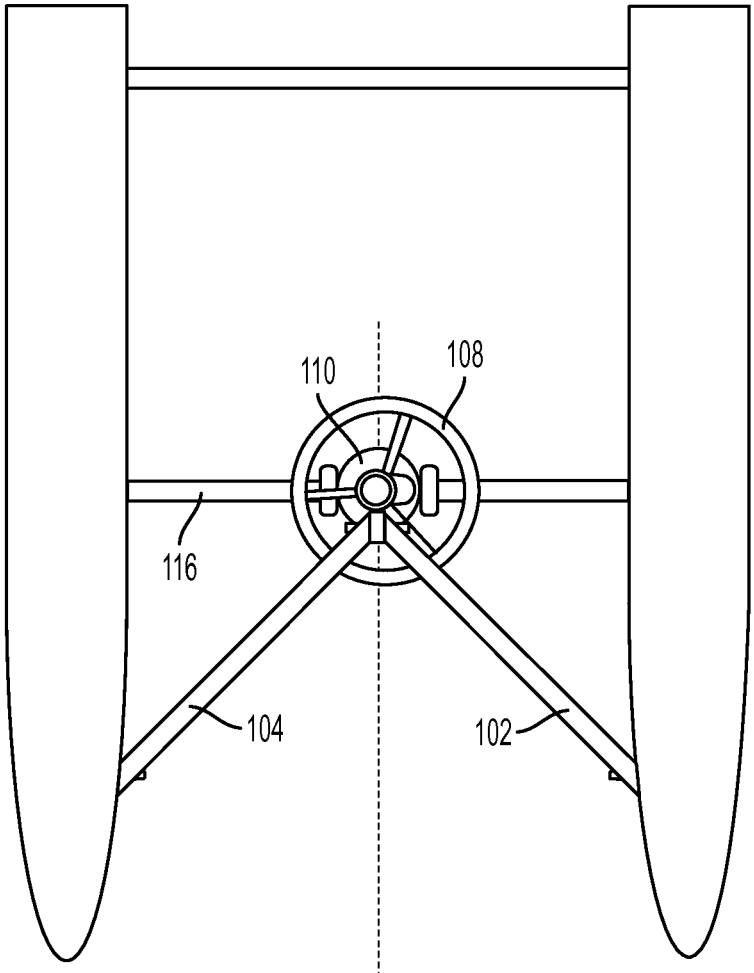
FIG. 12A is a top plan view of the mast canting assembly for the instant invention.
Figure 12B:
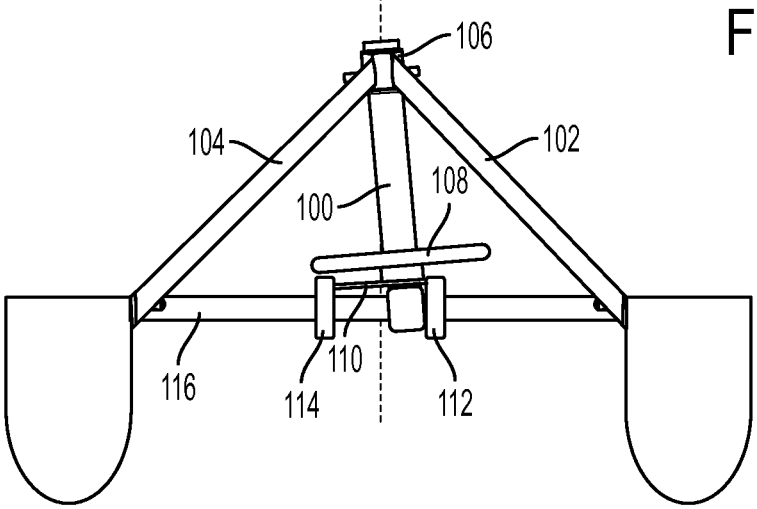
FIG. 12B is a front plan view of the apparatus shown in FIG. 12A.

The surface of the rectangular wingsail is pictured in FIGS. 10 and 11. FIG. 10 depicts the wingsail 127, the dual surfaces formed by bending around the upper and lower brackets around vertical axis 128, in a similar manner to that described with the previous round or oval wingsails. Batten slots 130 house battens 132, which are curved when the wingsail is curved around the brackets 48 and 50 to form the dual wingsail surfaces and profile. The previous described flexible straps are applicable as well. Two or more grommets 126 along the trailing edge of the surface provide connection points to the gaff and boom as well as the means of joining the two edges together. The drawstring flaps on the top and bottom edges of the wingsail surface fit into slippery grooves in the outer edges of the oval brackets as previously described. A triangular bracket 134 moves the bow stay connection point forward to provide clearance between the stay 136 and the wingsail.

Despite many previous attempts to create a practical flexible wingsail, relatively few have ever been produced. The most significant differences between the current invention and previous designs are the means employed to support and control the wingsail surface and the mast.

The above inventions have been described and illustrated with the reference structure, components and functions. Modifications and variations thereof will occur to those of ordinary skill in the art, and it is intended such modifications and variations will be within the scope of the inventive subject matter.

What is claimed is:

1. An aerodynamic wingsail and mast assembly for a vessel, said wingsail and mast assembly not having a boom or gaff, comprising:

a lightweight sailcloth having a plurality of tubular slots;

a plurality of batten strips, said batten strips being positioned within said tubular slots;

a mast for supporting said wingsail;

said sailcloth and batten strips being folded about itself and said mast, forming a rounded leading edge and dual surface profile for said wingsail;

said sailcloth having opposite sides which are held together with inward tension by a series of internal flexible straps creating a cross-section profile for said wingsail;

said wingsail being secured to said mast;

a top bracket and a bottom bracket, each said bracket having internal sleeves for positioning about said mast;

said top bracket raised or lowered through a pulley and halyard assembly;

said top bracket and bottom bracket respectively supporting a top edge and a bottom edge of said wingsail; and said mast being free standing, without the use of stays, said brackets being freely rotational, thereby providing enhanced operational control of said wingsail.

2. The apparatus of claim 1 wherein said wingsail further comprises at least one internal ring and at least one internal strap secured through said ring providing resilient movement of said strap and said wingsail.

3. The apparatus of claim 1, wherein said mast is secured to said vessel by one or more diagonal struts.

4. The apparatus of claim 3, further comprising:

an adjustable canting assembly, said canting assembly controlling movement of said mast.

5. The apparatus of claim 4 wherein said canting assembly further includes a control wheel and an offset disc which when rotated causes movement of said mast.

6. The apparatus of claim 1, wherein said top bracket is generally oval in shape and further comprises a forward section having a flotation member.

7. The apparatus of claim 1, further comprising:

a camber control assembly, said camber control assembly controlling positioning and curvature of said wingsail and aerodynamic forces acting thereon.

8. The apparatus of claim 7 wherein said camber control assembly includes a stepped pulley assembly, camber actuator and camber control.

9. The apparatus of claim 1, wherein said wingsail is generally rectangular with an angled trailing edge.

10. The apparatus of claim 1, wherein said wingsail is generally circular, and incorporates at least one curved batten about its periphery.

11. The apparatus of claim 1, wherein said wingsail is generally oval, and incorporates at least one curved batten about its periphery.

12. An aerodynamic wingsail and mast assembly for a vessel, comprising:

a lightweight sailcloth having a plurality of tubular slots;

a plurality of batten strips, said batten strips being positioned within said tubular slots;

a mast for supporting said wingsail;

said sailcloth and batten strips being folded about itself and said mast, forming a rounded leading edge and dual surface profile for said wingsail;

said sailcloth having opposite sides which are held together with inward tension by a series of internal flexible straps creating a cross-section profile for said wingsail;

said wingsail being secured to said mast;

a top bracket and a bottom bracket, each said bracket having internal sleeves for positioning about said mast;

said top bracket raised or lowered through a pulley and halyard assembly;

said top bracket and bottom bracket respectively supporting a top edge and a bottom edge of said wingsail;

said wingsail being generally rectangular with an angled trailing edge;

said mast being secured by at least one stay, said brackets being rotational, thereby providing enhanced operational control of said wingsail.

13. The apparatus of claim 12 further comprising:

a gaff rotatably secured to said top bracket and a boom rotatably secured to said bottom bracket for horizontal movement, said gaff and said boom supporting said wingsail surface through various degrees of camber or curvature created by wind force.

14. The apparatus of claim 13 further comprising:

a forward stay bracket secured to said mast above said top bracket, said forward stay bracket securing said stay to said mast and providing clearance for said wingsail.

15. An aerodynamic wingsail and mast for a vessel, said wingsail and mast not having a boom or gaff, comprising:

a lightweight sailcloth having a generally semi-circular shape;

said sailcloth having a forward sleeve section for receiving said mast;

said sailcloth having a curved sleeve trailing edge;

a resilient bow rod for tensioning and supporting said sailcloth;

said sailcloth trailing edge receiving said bow rod;

a pair of curved, open-ended brackets secured to opposite ends of said bow rod;

said brackets removably attached to said mast, said open-ended brackets engaging said mast;

said sailcloth and said bow rod being removable from said mast by simply by releasing tension in said bow rod and detaching said brackets, causing said bow rod to straighten along said mast, and sliding said sailcloth off said mast; and said mast being free standing, without the use of stays, said bow rod and said sailcloth being freely rotational through 360°.

16. The apparatus of claim 15 wherein said sailcloth has a semi-oval shape.

17. The apparatus of claim 15 wherein said mast further includes a pair of flanges, said bow rod brackets being positioned and constrained by said flanges about said mast.

18. The apparatus of claim 15 wherein said sailcloth including rotation control means attached to said trailing edge.

* * * * *